US006668477B1

(12) United States Patent
Cannady

(10) Patent No.: US 6,668,477 B1
(45) Date of Patent: Dec. 30, 2003

(54) PICTURE FRAME PROVIDING THREE DIMENSIONAL VISUAL EFFECTS

(76) Inventor: Shellie J. Cannady, 1408-26th Ave., Seattle, WA (US) 98122

( * ) Notice: Subject to any disclaimer, the term of this patent is extended or adjusted under 35 U.S.C. 154(b) by 0 days.

(21) Appl. No.: 10/177,321

(22) Filed: Jun. 21, 2002

(51) Int. Cl.[7] ..... A47G 1/06

(52) U.S. Cl. ..... 40/716; 40/743; 40/747; 40/564

(58) Field of Search ..... 40/219, 427, 442, 40/506, 564, 716, 743, 747, 900, 575

(56) References Cited

U.S. PATENT DOCUMENTS

| | | | | | |
|---|---|---|---|---|---|
| 1,776,496 | A | * | 9/1930 | Eiland | 359/607 |
| 2,286,247 | A | * | 6/1942 | Yearta | 40/219 |
| 2,483,901 | A | * | 10/1949 | Harris | 40/442 |
| 3,220,132 | A | * | 11/1965 | Swiger et al. | 40/711 |
| 5,132,839 | A | | 7/1992 | Travis | |
| 5,199,202 | A | * | 4/1993 | Musgrave | 40/219 |
| 5,265,357 | A | | 11/1993 | Yu | |
| 5,600,402 | A | | 2/1997 | Kainen | |
| D378,785 | S | | 4/1997 | Gearing | |
| 5,629,796 | A | | 5/1997 | Shanks | |
| 5,636,914 | A | | 6/1997 | Trusiani | |
| 6,557,284 | B2 | * | 5/2003 | Nolan | 40/574 |

FOREIGN PATENT DOCUMENTS

| | | | | |
|---|---|---|---|---|
| GB | 2256960 | * | 12/1992 | 40/743 |

* cited by examiner

*Primary Examiner*—Brian K. Green

(57) ABSTRACT

A picture frame for providing three dimensional visual effects to pictures. The picture frame includes a base stand including a base portion and upright end portions having ends which are disposed parallel to the base portion. A box member has side walls, a back wall, a front wall having an opening therethrough. The box member is pivotally mounted to the base stand. Mirrors are mounted upon the side, bottom and top walls in the box member. A light-emitting assembly is attached to the box member for illuminating inside the box member. A window securely disposed in the opening in the front wall. A picture stand which includes a base member having slots therein and which is securely mounted upon the bottom wall of the box member. A picture which is removably supported in the slots in the base member and faces the window and is visible through the window.

10 Claims, 3 Drawing Sheets

PICTURE FRAME PROVIDING THREE DIMENSIONAL VISUAL EFFECTS

BACKGROUND OF THE INVENTION

1. Field of the Invention

The present invention relates to a 3-D picture framing and more particularly pertains to a new picture frame providing three dimensional visual effects for providing three dimensional visual effects to pictures.

2. Description of the Prior Art

The use of 3-D picture framing is known in the prior art. More specifically, 3-D picture framing heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,265,357; U.S. Pat. No. 5,636,914; U.S. Pat. No. Des. 378,785; U.S. Pat. No. 5,629,796; U.S. Pat. No. 5,132,839; and U.S. Pat. No. 5,600,402.

While these devices fulfill their respective, particular objectives and requirements, the aforementioned patents do not disclose a new picture frame providing three dimensional visual effects. The inventive device includes a base stand including a base portion and upright end portions having ends which are disposed parallel to the base portion; and further includes a box member having side walls, a back wall, a front wall having an opening therethrough with the box member being pivotally attached to the base stand; and further includes mirrors being mounted upon the side, bottom and top walls in the box member; and also includes a light-emitting assembly being attached to the box member for illuminating inside the box member; and further includes a window securely disposed in the opening in the front wall; and also includes a picture stand which includes a base member having slots therein and which is securely mounted upon the bottom wall of the box member; and further includes a picture which is removably supported in the slots in the base member and having its front side facing the window and being visible through the window.

In these respects, the picture frame providing three dimensional visual effects according to the present invention substantially departs from the conventional concepts and designs of the prior art, and in so doing provides an apparatus primarily developed for the purpose of providing three dimensional visual effects to pictures.

SUMMARY OF THE INVENTION

In view of the foregoing disadvantages inherent in the known types of 3-D picture framing now present in the prior art, the present invention provides a new picture frame providing three dimensional visual effects construction wherein the same can be utilized for providing three dimensional visual effects to pictures.

The general purpose of the present invention, which will be described subsequently in greater detail, is to provide a new picture frame providing three dimensional visual effects which has many of the advantages of the 3-D picture framing mentioned heretofore and many novel features that result in a new picture frame providing three dimensional visual effects which is not anticipated, rendered obvious, suggested, or even implied by any of the prior art 3-D picture framing, either alone or in any combination thereof.

To attain this, the present invention generally comprises a base stand including a base portion and upright end portions having ends which are disposed parallel to the base portion; and further includes a box member having side walls, a back wall, a front wall having an opening therethrough with the box member being pivotally mounted to the base stand; and further includes mirrors being mounted upon the side, bottom and top walls in the box member; and also includes a light-emitting assembly being attached to the box member for illuminating inside the box member; and further includes a window securely disposed in the opening in the front wall; and also includes a picture stand which includes a base member having slots therein and which is securely mounted upon the bottom wall of the box member; and further includes a picture which is removably supported in the slots in the base member and having its front side facing the window and being visible through the window.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new picture frame providing three dimensional visual effects which has many of the advantages of the 3-D picture framing mentioned heretofore and many novel features that result in a new picture frame providing three dimensional visual effects which is not anticipated, rendered obvious, suggested, or even implied by any of the prior art 3-D picture framing, either alone or in any combination thereof.

It is another object of the present invention to provide a new picture frame providing three dimensional visual effects which may be easily and efficiently manufactured and marketed.

It is a further object of the present invention to provide a new picture frame providing three dimensional visual effects which is of a durable and reliable construction.

An even further object of the present invention is to provide a new picture frame providing three dimensional visual effects which is susceptible of a low cost of manufacture with regard to both materials and labor, and which accordingly is then susceptible of low prices of sale to the consuming public, thereby making such picture frame providing three dimensional visual effects economically available to the buying public.

Still yet another object of the present invention is to provide a new picture frame providing three dimensional visual effects which provides in the apparatuses and methods of the prior art some of the advantages thereof, while simultaneously overcoming some of the disadvantages normally associated therewith.

Still another object of the present invention is to provide a new picture frame providing three dimensional visual effects for providing three dimensional visual effects to pictures.

Yet another object of the present invention is to provide a new picture frame providing three dimensional visual effects which includes a base stand including a base portion and upright end portions having ends which are disposed parallel to the base portion; and further includes a box member having side walls, a back wall a front wall having an opening therethrough with the box member being pivotally mounted to the base stand; and further includes mirrors being mounted upon the side, bottom and top walls in the box member; and also includes a light-emitting assembly being attached to the box member for illuminating inside the box member; and further includes a window securely disposed in the opening in the front wall; and also includes a picture stand which includes a base member having slots therein and which is securely mounted upon the bottom wall of the box member; and further includes a picture which is removably supported in the slots in the base member and having its front side facing the window and being visible through the window.

Still yet another object of the present invention is to provide a new picture frame providing three dimensional visual effects that adds life to one dimensional pictures or postcards.

Even still another object of the present invention is to provide a new picture frame providing three dimensional visual effects that enhances the visual effects of cherished pictures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
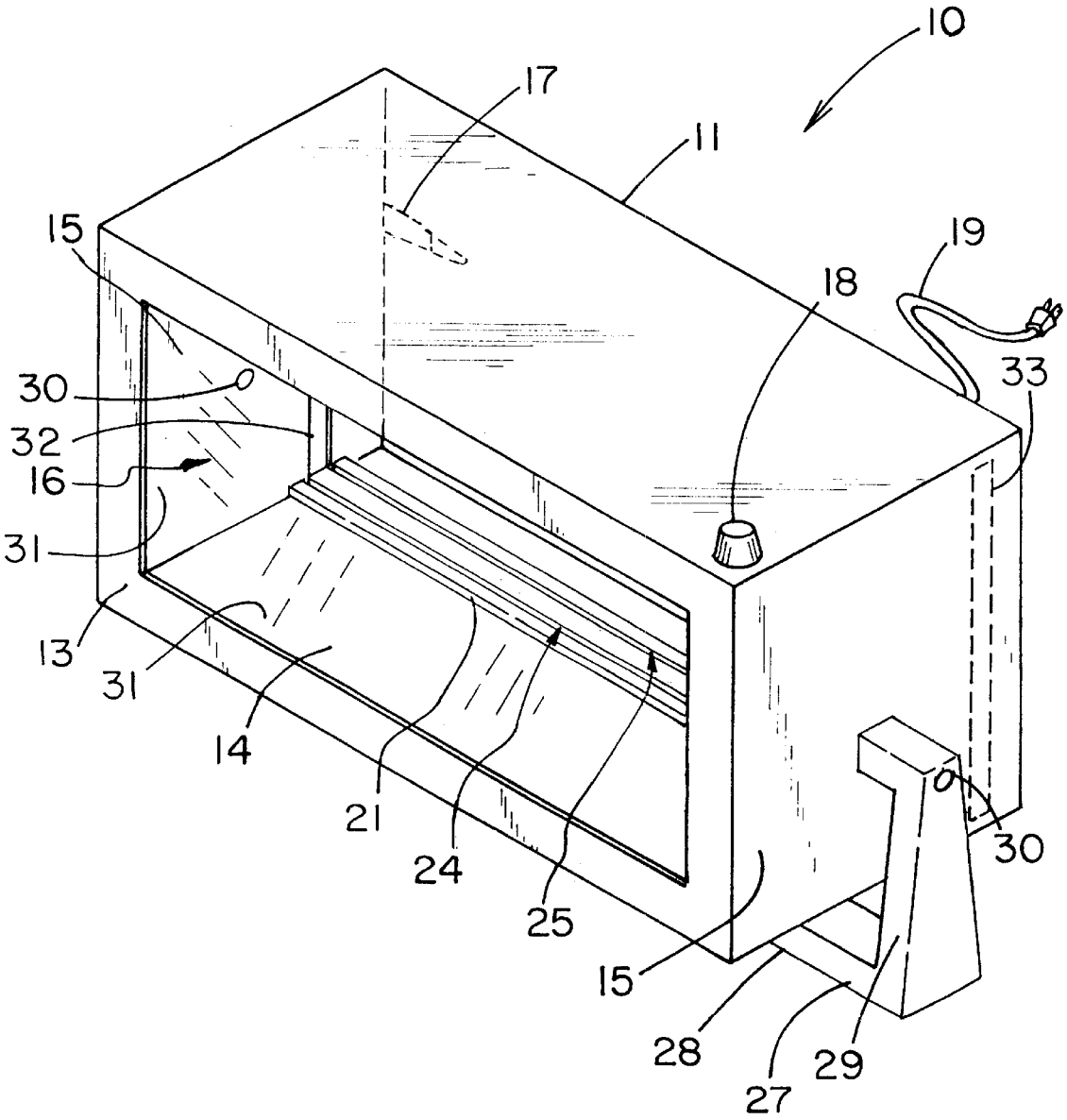
FIG. 1 is a front perspective view of a new picture frame providing three dimensional visual effects according to the present invention.
Figure 2:
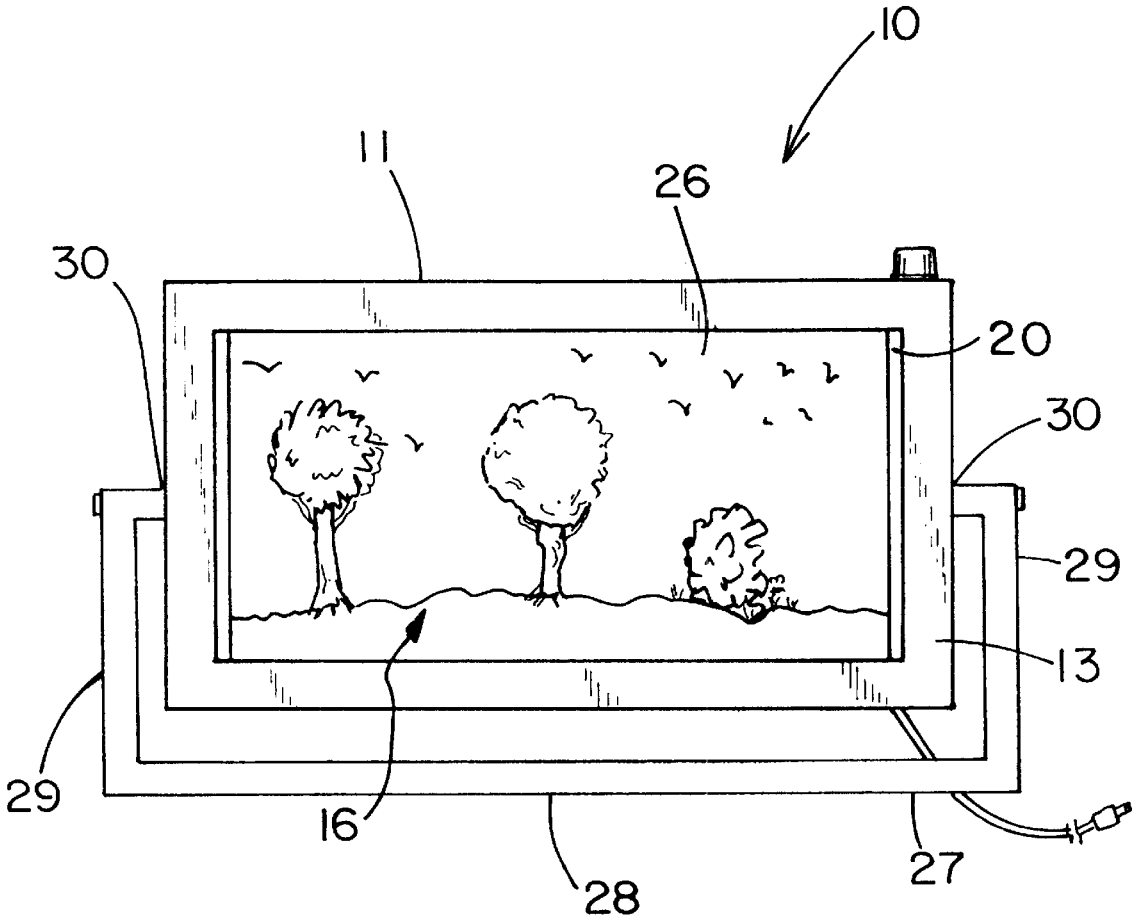
FIG. 2 is a front elevational view of the present invention.
Figure 3:
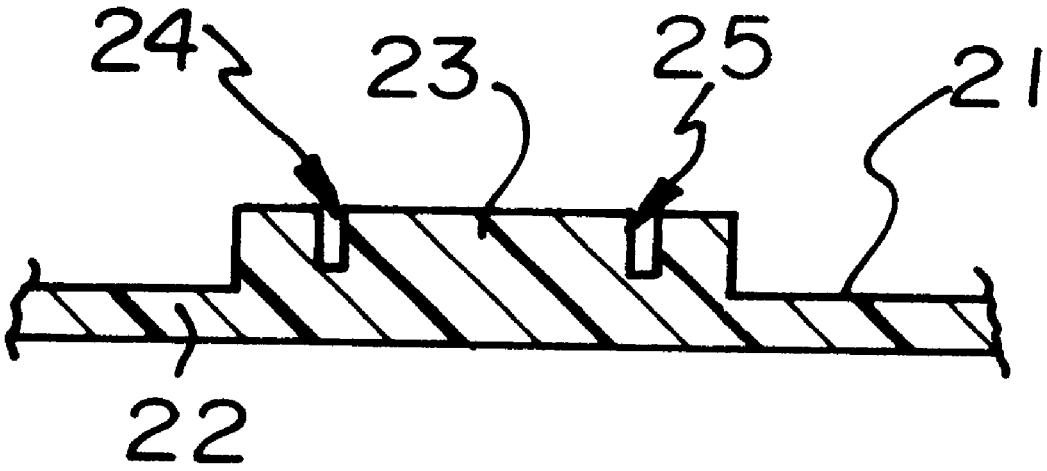
FIG. 3 is a detailed side elevational view of the picture stand of the present invention.

With reference now to the drawings, and in particular to FIGS. 1 through 3 thereof, a new picture frame providing three dimensional visual effects embodying the principles and concepts of the present invention and generally designated by the reference numeral 10 will be described.

As best illustrated in FIGS. 1 through 3, the picture frame providing three dimensional visual effects 10 generally comprises a support stand 27 having a base portion 28 and a pair of upright end portions 29 extending upwardly from ends of the base portion 28 and having ends 30 which are disposed parallel to the base portion 28. A box member 11 has side walls 15, a top wall, a bottom wall 14, a back wall 12, and a front wall 13 with the side walls 15 of the box member 11 being pivotally and conventionally mounted to the ends 30 of the upright end portions 29 of the support stand 27. Each of the front 13 and back 14 walls has an opening 16, therethrough. The box member 11 has a length of approximately 9 inches and a width of approximately 7 inches and a depth of approximately 4 inches. The box member 11 also includes longitudinal slots 32,33 being conventionally disposed in the side walls 15 in the box member 11 with the longitudinal slots 32,33 extending from the bottom wall 14 to the top wall. Mirrors 31 are securely and conventionally attached to the side, bottom and top walls 14,15 in the box member 11. A light-emitting assembly is conventionally attached to the box member 11 for illuminating inside the box member 11. The light-emitting assembly includes a light-emitting member 17 being conventionally disposed upon the top wall in the box member 11, and also includes an on/off switch 18 being conventionally mounted upon a top of the top wall of the box member 11, and further includes a power cord 19 being conventionally connected to the light-emitting member 17 and the on/off switch 18. A window member 20 is securely and conventionally disposed at the opening 16 in the front wall 13. A picture stand 21 is securely and conventionally mounted upon the bottom wall 14 inside the box member 11. The picture stand 21 includes a base member 22 having a raised central portion 23. The central portion 23 includes a pair of slots 24,25 spaced apart and disposed therein with the slots 24,25 being vertically disposed and extending through a top of the central portion 23. Each of the slots 24,25 is adapted to receive a bottom portion of the picture 26. The base member 22 is spaced approximately 1½ inches from the window 20 for effecting 3-D visual images. A picture 26 having a depth is removably mounted upon the picture stand 21. The picture 26 is adapted to be removably mounted in the slots 24,25 and to be vertically disposed inside the box member 11 with a front of the picture 26 facing the window 20 and being visible through the window 20. The picture 26 has a depth of approximately 1½ inches.

In use, the user places either a picture 26 or a postcard in the slots 24,25 inside the box member 11. By viewing the picture 26 or postcard through the window 20, the user will be able to see a three dimensional image of the picture 26 or postcard with the picture 26 being illuminated with the light-emitting member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A picture frame providing three dimensional visual effects comprising:

a base stand including a base portion and upright end portions having ends which are disposed parallel to said base portion;

a box member having side walls, a top wall, a bottom wall, a back wall, and a front wall, said front wall having an opening therethrough with said box member being pivotally mounted to said base stand;

mirrors being mounted upon said side, bottom and top walls in said box member;

a light-emitting assembly being attached to said box member for illuminating inside of said box member;

a window member being securely disposed at said opening in said front wall a picture stand securely mounted upon said bottom wall inside said box member; and a picture having a depth and being removably mounted upon said picture stand.

2. A picture frame providing three dimensional visual effects as described in claim 1, wherein said box member also includes longitudinal slots being disposed in said side walls in said box member, said longitudinal slots extending from said bottom wall to said top wall.

3. A picture frame providing three dimensional visual effects as described in claim 1, wherein said light-emitting assembly includes a light-emitting member being disposed upon said top wall in said box member, and also includes an on/off switch being mounted upon a top of said top wall of said box member, and further including a power cord being connected to said light-emitting member and to said on/off switch.

4. A picture frame providing three dimensional visual effects as described in claim 1, wherein said picture stand includes a base member having a raised central portion.

5. A picture frame providing three dimensional visual effects as described in claim 4, wherein said central portion includes a pair of slots spaced apart and disposed therein.

6. A picture frame providing three dimensional visual effects as described in claim 5, wherein said slots are horizontally disposed and extend through a top of said central portion, each of said slots being adapted to receive a bottom portion of said picture.

7. A picture frame providing three dimensional visual effects as described in claim 6, wherein said picture is adapted to be removably mounted in said slots and to be vertically disposed inside said box member with a front of said picture facing said window and being visible through said window.

8. A picture frame providing three dimensional visual effects as described in claim 7, wherein said base member is spaced approximately 1½ inches from said window for effecting 3-D visual images.

9. A picture frame providing three dimensional visual effects as described in claim 8, wherein said picture is positioned at a depth of approximately 1½ inches from said window.

10. A picture frame providing three dimensional visual effects comprising:

a base stand including a base portion and upright end portions having ends which are disposed parallel to said base portion;

a box member having side walls, a top wall, a bottom wall, a back wall, and a front wall, said front wall having an opening therethrough with said box member being pivotally mounted to said base stand, said box member having a length of approximately 9 inches and having a width of approximately 7 inches and having a depth of approximately 4 inches, said box member also including longitudinal slots being disposed in said side walls in said box member, said longitudinal slots extending from said bottom wall to said top wall;

mirrors being securely attached to said side, bottom, and top walls in said box member;

a light-emitting assembly being attached to said box member for illuminating inside of said box member, said light-emitting assembly including a light-emitting member being disposed upon said top wall in said box member, and also including an on/off switch being mounted upon a top of said top wall of said box member, and further including a power cord being connected to said light-emitting member and to said on/off switch;

a window member being securely disposed at said opening in said front wall;

a picture stand securely mounted upon said bottom wall inside said box member said picture stand including a base member having a raised central portion, said central portion including a pair of slots spaced apart and disposed therein, said slots of said base member being vertically disposed and extending through a top of said central portion; and a picture having a depth and being removably mounted upon said picture stand; said picture being adapted to be removably mounted in said slots of said base member and to be vertically disposed inside said box member with a front of said picture facing said window and being visible through said window, each of said slots of said base member being adapted to receive a bottom portion of said picture, said base member being spaced approximately 1½ inches from said window for effecting 3-D visual images, said picture being positioned at a depth of approximately 1½ inches from said window.

* * * * *